US008667822B1

(12) United States Patent
Jaffe et al.

(10) Patent No.: US 8,667,822 B1
(45) Date of Patent: Mar. 11, 2014

(54) BRACELET CONCEALING HANDCUFF KEY

(71) Applicant: Shomer-Tec, Inc., Bellingham, WA (US)

(72) Inventors: Joel Jaffe, Bellingham, WA (US); Jeffery Jaffe, Bellingham, WA (US)

(73) Assignee: Schomer-Tec, Inc., Bellingham, WA (US)

( * ) Notice: Subject to any disclaimer, the term of this patent is extended or adjusted under 35 U.S.C. 154(b) by 0 days.

(21) Appl. No.: 13/753,365

(22) Filed: Jan. 29, 2013

(51) Int. Cl.
*E05B 19/00* (2006.01)

(52) U.S. Cl.
USPC ..... 70/395; 70/16; 70/456 R; 63/1.12

(58) Field of Classification Search
USPC ..... 70/395, 456 R, 16; 63/1.12
See application file for complete search history.

(56) References Cited

U.S. PATENT DOCUMENTS

| | | | | | |
|---|---|---|---|---|---|
| 367,804 | A | * | 8/1887 | Frere | 63/1.12 |
| 839,047 | A | * | 12/1906 | Sylvester | 24/625 |
| 2,266,942 | A | * | 12/1941 | Wallace | 63/1.12 |
| 2,413,337 | A | * | 12/1946 | Samuel | 224/163 |
| 2,449,181 | A | * | 9/1948 | Smiley | 40/633 |
| 2,771,768 | A | * | 11/1956 | Tudor | 70/457 |
| 3,019,635 | A | * | 2/1962 | Kling | 70/456 R |
| 3,124,286 | A | * | 3/1964 | Dompier | 224/255 |
| 3,272,410 | A | * | 9/1966 | Emeric | 224/163 |
| 4,037,442 | A | * | 7/1977 | Staude et al. | 70/456 R |
| 4,125,920 | A | * | 11/1978 | Grimes | 224/165 |
| 4,301,664 | A | * | 11/1981 | Wilcox | 63/1.12 |
| 4,489,867 | A | * | 12/1984 | Schwemberger | 224/222 |
| D282,962 | S | * | 3/1986 | Gerber | D23/262 |
| 4,778,302 | A | * | 10/1988 | Martinez | 401/195 |
| 4,795,410 | A | * | 1/1989 | Alderfer | 474/256 |
| 5,123,579 | A | * | 6/1992 | Sugiyama | 224/163 |
| 5,460,022 | A | * | 10/1995 | Parsons | 70/456 R |
| 5,568,741 | A | * | 10/1996 | Parsons | 70/456 R |
| 5,584,195 | A | * | 12/1996 | Liu | 63/1.12 |
| 5,622,293 | A | * | 4/1997 | LeFevre | 224/148.2 |
| 5,704,236 | A | * | 1/1998 | Parsons | 70/456 R |
| 5,706,683 | A | * | 1/1998 | Napier | 70/398 |
| D390,090 | S | * | 2/1998 | Tobin, Jr. | D8/347 |
| 5,937,680 | A | * | 8/1999 | Parsons | 70/456 R |
| 6,280,046 | B1 | * | 8/2001 | Perez | 362/116 |
| D454,774 | S | * | 3/2002 | Stahl | D8/347 |
| 6,554,684 | B2 | * | 4/2003 | Marlin | 446/486 |
| 6,581,811 | B1 | * | 6/2003 | Schillaci | 224/148.2 |
| 6,880,369 | B2 | * | 4/2005 | Parsons | 70/16 |
| 7,520,149 | B1 | * | 4/2009 | Roemmele | 70/16 |
| D596,923 | S | * | 7/2009 | Ramos | D8/347 |
| D596,924 | S | * | 7/2009 | Ramos | D8/347 |
| 7,661,896 | B2 | * | 2/2010 | Zawitz | 401/6 |
| 7,766,193 | B2 | * | 8/2010 | Stollmann et al. | 222/175 |
| 7,866,840 | B2 | * | 1/2011 | Padden | 362/119 |
| 2005/0028570 | A1 | * | 2/2005 | Parsons | 70/16 |
| 2005/0044887 | A1 | * | 3/2005 | Kaufman et al. | 63/1.12 |
| 2011/0127293 | A1 | * | 6/2011 | Pascatore | 222/1 |
| 2012/0159987 | A1 | * | 6/2012 | Walchle et al. | 63/3.2 |
| 2013/0031935 | A1 | * | 2/2013 | Kelleghan | 63/1.12 |

* cited by examiner

*Primary Examiner* — Suzanne Barrett
(74) *Attorney, Agent, or Firm* — Dwayne E. Rogge; Schacht Law Office, Inc.

(57) ABSTRACT

Described herein are examples of concealed handcuff keys including a key concealed as a bracelet.

5 Claims, 4 Drawing Sheets

BRACELET CONCEALING HANDCUFF KEY

BACKGROUND OF THE DISCLOSURE a) Field of the Disclosure

This disclosure relates to the field of concealed handcuff keys hidden within or as common items (hidden in plain sight).

SUMMARY OF THE DISCLOSURE

Described herein are several versions of concealed handcuff keys including a handcuff key concealed within a bracelet.

In the fields of law enforcement, and military service, being handcuffed by a malefactor is obviously dangerous. As malefactors would have reason to believe that the victim has a key to handcuffs on their person, and as many handcuff keys are universal, the malefactor may search the victim for such a key. Thus, it is very desirous for the victim to have on their person, one or more hidden handcuff keys, which would seem to the malefactor to be common items, and would go unnoticed. The hidden keys should be available to the victim while handcuffed.

Disclosed are several embodiments of handcuff keys which concealed as everyday items which will normally be overlooked by an aggressor during a search.

DESCRIPTION OF THE PREFERRED EMBODIMENTS

Figure 1:
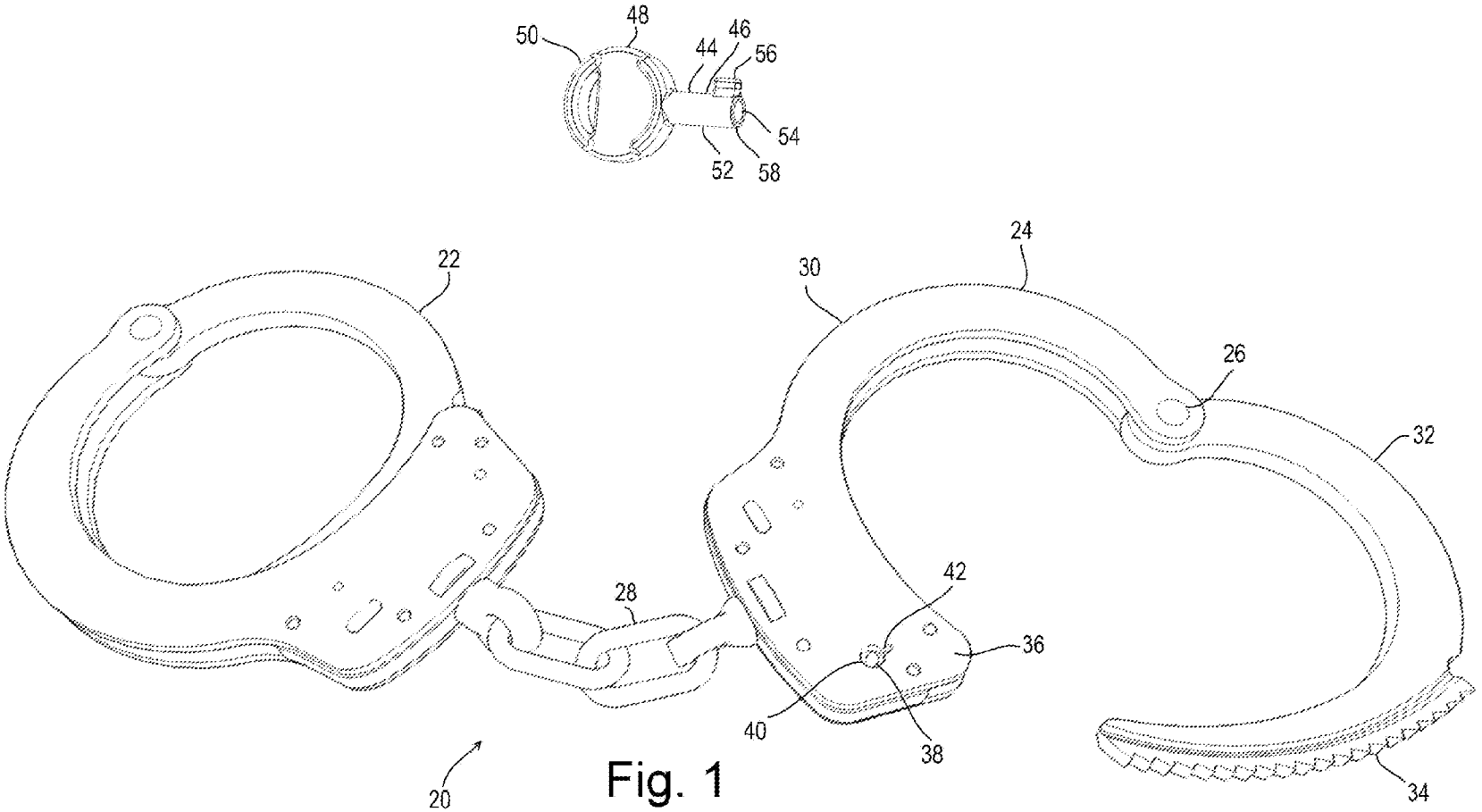
Fig. 1 Prior Art
FIG. 1 is an isometric view of a prior art set of handcuffs and key.

Many modern handcuffs in Canada, the United States, the United Kingdom, Latin America, and elsewhere can be opened with a standard universal handcuff key. On example of such a key 44 is shown in FIG. 1 adjacent a common set of handcuffs? This standardization allows for easier transport of prisoners and allows for easy removal of cuffs should a key be lost. One such set of handcuffs 20 are shown in FIG. 1 and generally comprise a pair of handcuff portions 22 and 24 with a chain 28 holding the two handcuff portions adjacent to each other. Each handcuff may be made of separate sub-portions 30 and 32, connected by a hinge pin 26 or similar component. A sawtooth portion 34 may be used in conjunction with a ratcheting locking mechanism 36 used to lock the handcuff closed. To unlock the handcuff, a key is placed into the handcuff keyway 38 which is generally a cylinder-shaped surface with a rectilinear extension 42, and then rotated such that a detent on the key releases the lock and the handcuffs may be opened. To increase security, a keyway pin 40 is normally provided, which prohibits many items from being used as keys. This is accomplished as the key must have an opening in the center thereof to receive the pin 40, must be sized to fit within the keyway 38, and must have a protrusion (flag) 56 or equivalent to release the locking mechanism.

A standard key 44 has a lock engagement portion 46 protruding from a grasping portion 48. In this example, the grasping portion has a cord engaging end 50 which allows attachment to a key ring, lanyard, necklace, zipper pull etc. The lock engaging portion 46 generally has a cylindrical outer surface 52 slightly smaller than the keyway 38 to fit therein. The lock engaging portion 46 also has a cylindrical inner surface 54 slightly larger than the pin 40 to fit therearound. Lastly, the lock engaging portion 46 generally includes a protrusion 56. When the insertion end 58 of the key 44 is inserted in the locking mechanism 36 and turned, pawls within the locking mechanism 36 are released from the sawtooth 34 so that the second portion 32 can be released from the locking mechanism 36 and rotate relative to the first portion 30 about the hinge pin 26. This manipulation opens the handcuffs and allows the cuffs to be removed.

Figure 2:
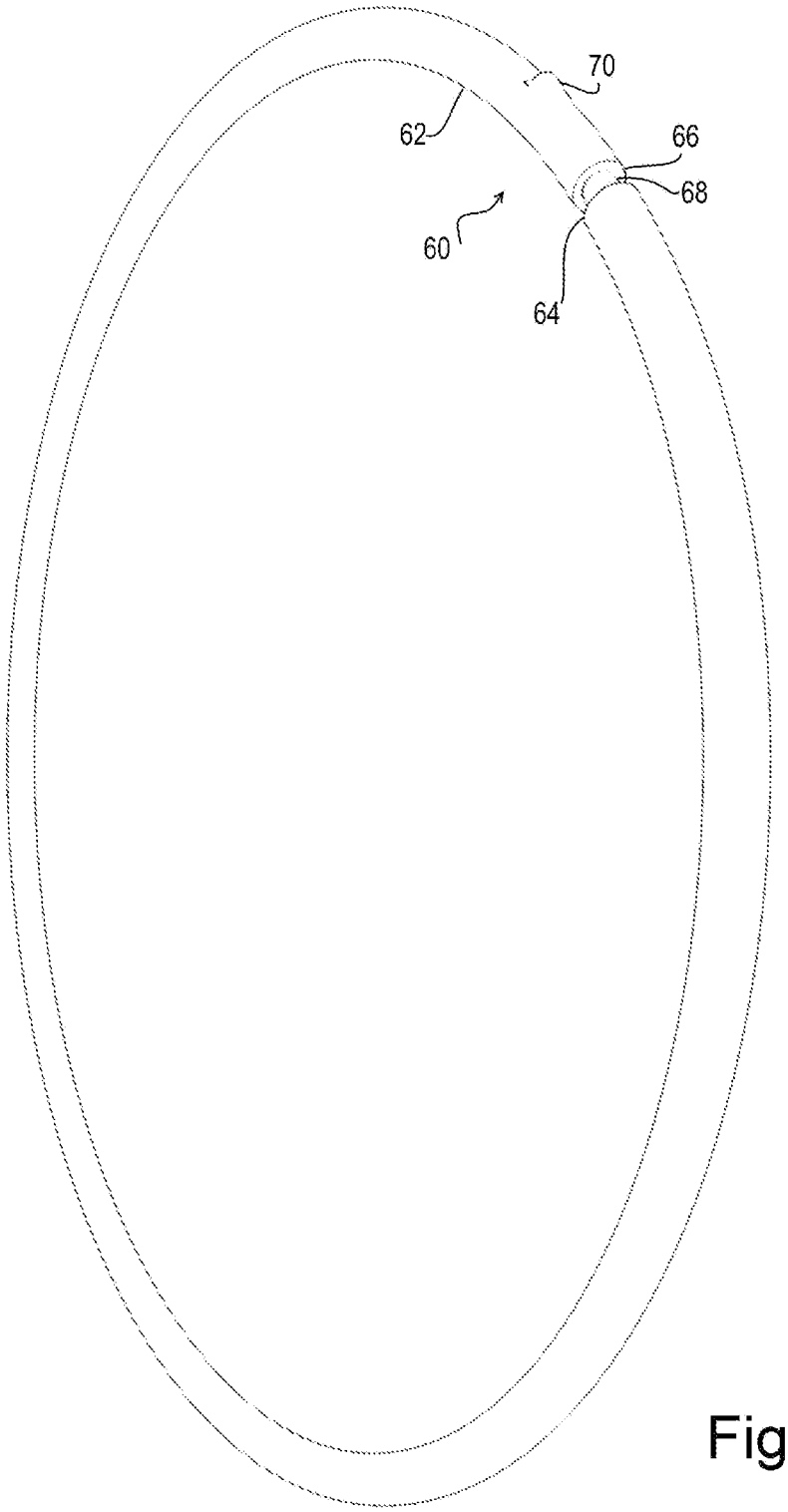
FIG. 2 is an isometric view of one example of the disclosed apparatus in a closed configuration.
Figure 3:
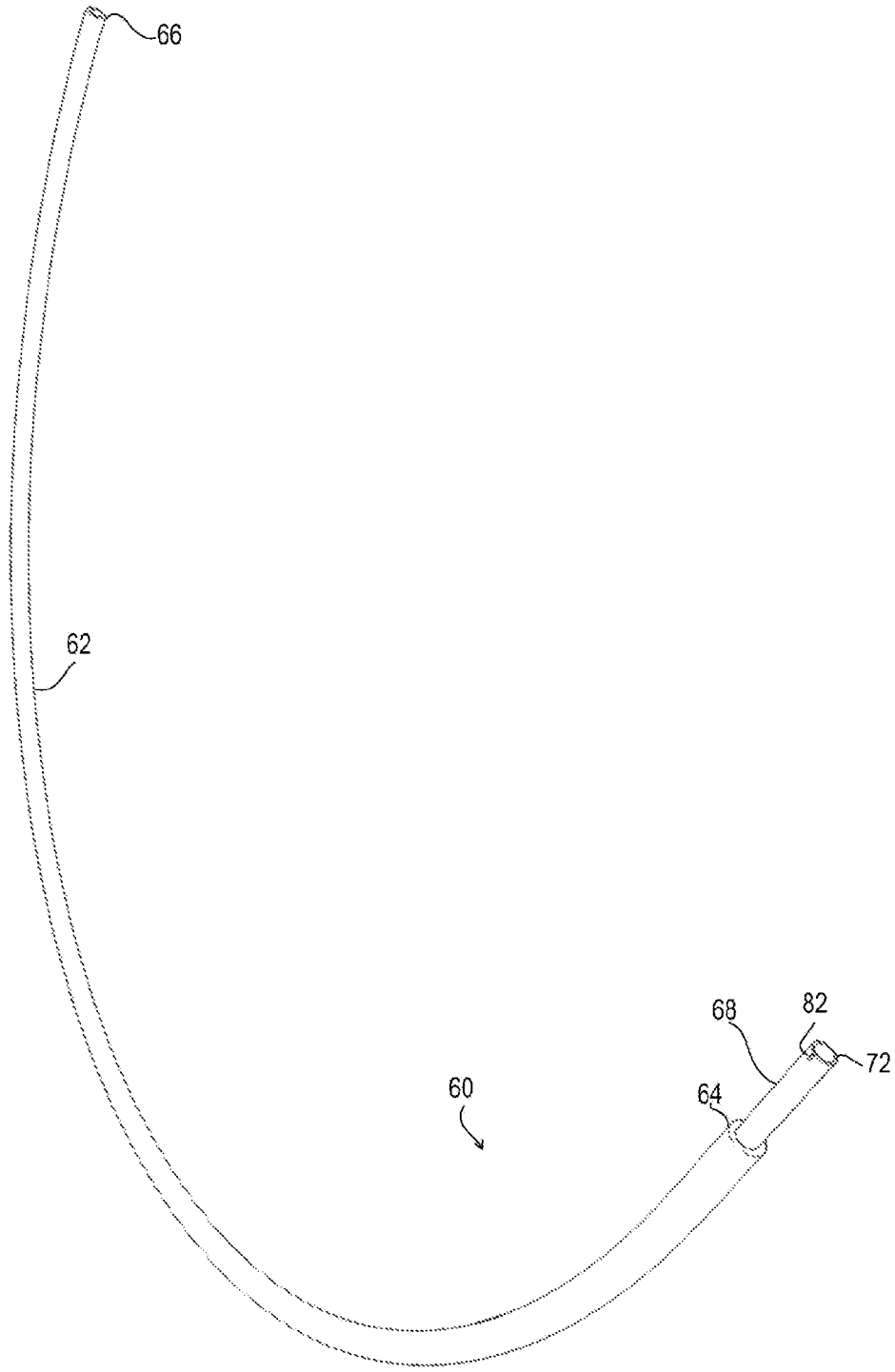
FIG. 3 is an isometric view of the example shown in FIG. 2 in an open configuration.

Looking now to FIG. 2 is shown a bracelet 60 in which is hidden a handcuff key 68 having the same unlocking function but a very different (smaller) profile than prior art keys 44. This arrangement allows the key 68 to be hidden within the bracelet, and as the bracelet has insignificant monetary value, it will likely be overlooked by antagonists. The bracelet 60 comprises a tube 62 having a first end 64 and a second end 66. The tube 62 is generally small in diameter. In one form, the resting (non-stretched) outer diameter of the tube is about 6 mm, but in another embodiment may range from 4-15 mm. The resting inner surface of the tube is also very small in diameter, in one embodiment about 3 mm. In one example, having an outer diameter of 6 mm and an inner diameter of 3 mm, the tube will have a wall thickness of about 1.5 mm. In FIG. 2, where the bracelet 60 is in a closed position, a protrusion 70 may be seen in some examples. In most examples this protrusion 70 is not visible. This protrusion will be described in more detail. In this closed position, the bracelet fits snugly around a wearer's wrist. As the tube 62 is a continuous and homogenous extrusion in one form, it may be easily cut to the proper length. One example has shown that a length of 26 cm fits well around most users' wrists.

Figure 4:
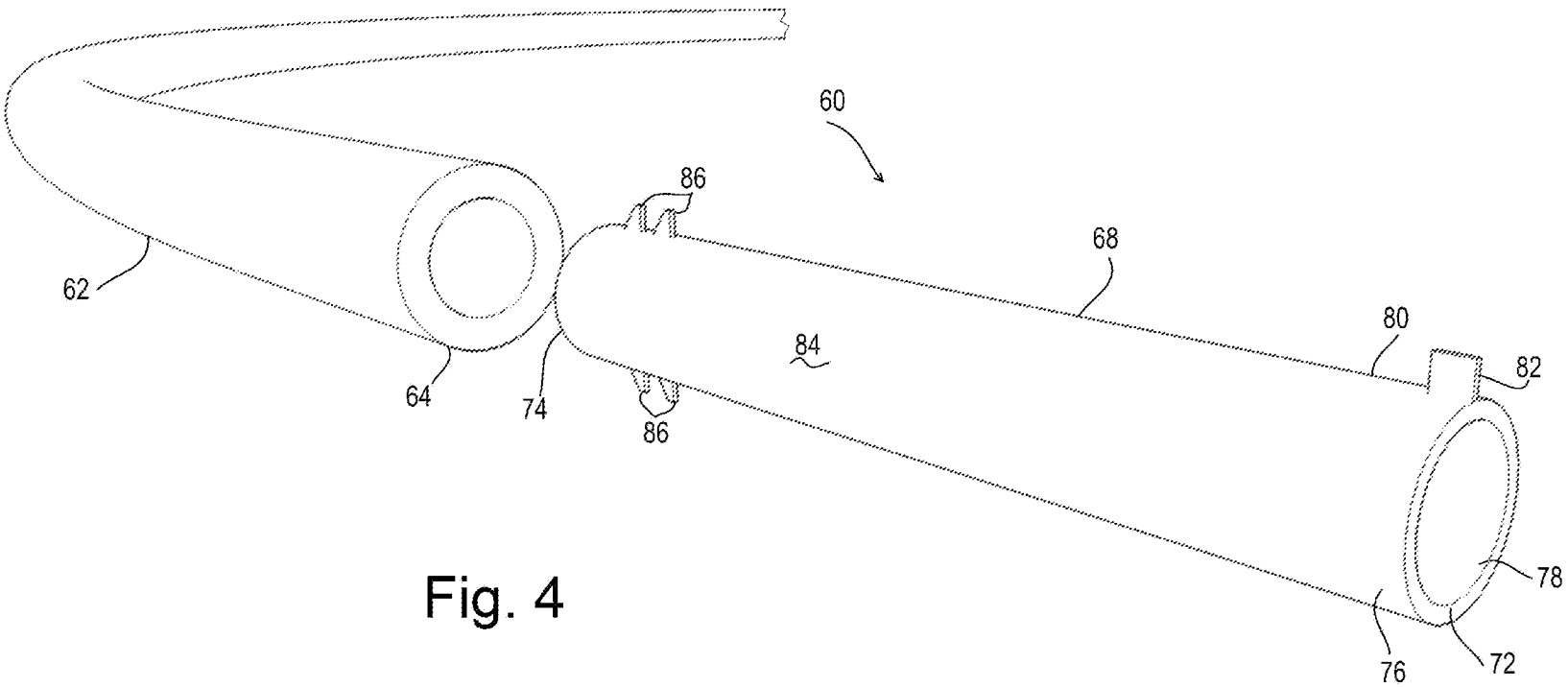
FIG. 4 is an isometric exploded and enlarged view of the example of FIG. 2.

Looking to the disassembled view of FIG. 4, it can be seen how the key 68 is generally cylindrical with a lock insertion end 72 and a tube insertion end 74. The lock engagement portion 80 of this example has a cylindrical outer surface 76 slightly smaller than the keyway 38 of the handcuff 24 to fit therein. The lock engaging portion 80 also has a cylindrical inner surface 78 slightly larger than the pin 40 of the handcuff 24 to fit therearound. Lastly, the lock engaging portion 80 generally includes a protrusion 82. As with a prior art key, when the insertion end 72 of the key 68 is inserted in the locking mechanism 36 and rotated, pawls within the locking mechanism 36 are released from the sawtooth 34 so that the second portion 32 of the handcuff 24 can be released from the locking mechanism 36 and rotate relative to the first portion 30 about the hinge pin 26. This manipulation opens the handcuffs and allows the cuffs to be removed.

In one example, the tube insertion end 74 of the key 68 may be simply inserted into the first end 64 of the tube 62 and held in place by frictional forces. Alternatively, adhesives or fasteners may be employed. In one form, where the tube 62 is an elastic polymer the elastic nature of the tube allows the tube to stretch and frictionally engage (hold) the outer surface 84 of the tube insertion end 74. In most embodiments, the outer surface 84 of the tube insertion end, and the outer surface 76 of the lock engagement end are slightly larger than the resting (non-stretched) inner diameter of the first end 64 of the tube 62.

Looking to FIG. 4 still, it can be seen in this example, barbs 86 are provided to ensure that the key 68 remains fixed within the tube 62. These barbs may be formed in many different configurations.

To place the bracelet around one's wrist, ankle, or elsewhere, once the tube insertion end 74 is fixed within the tube 62, the tube is wrapped around the wrist and the lock engagement portion 80 is inserted into the second end 66. As with the tube insertion end 74, the outer surface of the lock engagement portion 80 may slightly stretch the second end 66 of the tube 62 outward and frictionally engage thereto. The protrusion 82 also functions similarly to the barbs 86, as it keeps the tube 62 positioned on the lock engagement portion 80. The protrusion 70 is one example of the outer surface of the tube 62 being deformed outward due to the protrusion 82.

To remove the bracelet, a user simply grasps the bracelet at any point and pulls. As the tube insertion end 74 is attached to the tube 62 more firmly than the lock engagement portion 80, the bracelet should dethatch and expose the lock engagement portion 80 for use to release handcuffs.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

We claim:

1. A handcuff key assembly concealed as a bracelet comprising:

a. a key having a lock engagement portion and a tube insertion end each having an outer surface;

b. an elastic tube having a hollow first end of smaller diameter than the outer surface of the tube insertion end of the key and a hollow second end of smaller diameter than the outer diameter than the tube insertion end of the key;

c. the tube insertion end removably inserted into a first end of the elastic tube by deforming the elastic tube radially outward so as to frictionally engage the tube insertion end of the key;

d. the lock engagement portion having an outer surface, an inner surface, and a radial protrusion configured to unlock a set of handcuffs;

e. wherein the outer surface of the lock engagement end is removably fixed within the second end of the tube by deforming the elastic tube radially outward so as to frictionally engage the lock engagement end of the key; and f. wherein the tube surrounds the key and conceals the key from viewing.

2. The handcuff key as recited in claim 1 wherein the elastic tube is between 20 and 30 cm in length.

3. The handcuff key as recited in claim 1 wherein the outer diameter of the elastic tube is between 2 mm and 6 mm.

4. The handcuff key as recited in claim 1 wherein the inner diameter of the elastic tube at the first and second ends is between 1 mm and 4 mm.

5. The handcuff key as recited in claim 1 wherein the elastic tube is a unitary structure.

* * * * *

UNITED STATES PATENT AND TRADEMARK OFFICE

CERTIFICATE OF CORRECTION

PATENT NO. : 8,667,822 B1
APPLICATION NO. : 13/753365
DATED : March 11, 2014
INVENTOR(S) : Joel Jaffe and Jeffery Jaffe It is certified that error appears in the above-identified patent and that said Letters Patent is hereby corrected as shown below:

on the title page: (73) "Assignee: Schomer-Tec, Inc., Bellingham, WA (US)" should be

(73) "Assignee: Shomer-Tec, Inc., Bellingham, WA (US)"

Signed and Sealed this
Third Day of June, 2014

Michelle K. Lee

Michelle K. Lee
*Deputy Director of the United States Patent and Trademark Office*